United States Patent [19]

Sadamatsu et al.

[11] 4,197,119

[45] Apr. 8, 1980

[54] ELECTROPHOTOGRAPHIC PROCESS

[75] Inventors: Shigeru Sadamatsu; Kozo Oka, both of Minami-ashigara, Japan

[73] Assignee: Fuji Xerox Co., Ltd., Tokyo, Japan

[21] Appl. No.: 855,143

[22] Filed: Nov. 28, 1977

[30] Foreign Application Priority Data

Nov. 26, 1976 [JP] Japan ..... 51-141110

[51] Int. Cl.[2] ..... G03G 13/04; G03G 13/056

[52] U.S. Cl. ..... 430/55; 355/3 CH

[58] Field of Search ..... 96/1, 1 C, 1.3, 1 TE; 340/173 PP; 365/14 G; 355/3 CH

[56] References Cited

U.S. PATENT DOCUMENTS

| | | | |
|---|---|---|---|
| 3,676,117 | 7/1972 | Kinoshita | 96/1 R |
| 3,677,751 | 7/1972 | Ohta | 96/1 R |

*Primary Examiner*—John D. Welsh

*Attorney, Agent, or Firm*—Sughrue, Rothwell, Mion, Zinn and Macpeak

[57] ABSTRACT

In an electrophotographic process for the formation of an electrostatic latent image on a photosensitive element for electrophotography produced through the sequential lamination on an electrically conductive substrate of an electrically insulating layer, a photoconductive layer, and an electrically insulating surface layer by repeating a series of steps comprising a first charging; a light exposure of the entire surface; a second charging of a polarity opposite to that of the first charging; and an image-wise exposure to light, wherein the polarity between the first electrical charging and the second electrical charging is changed from positive to negative and vice versa simultaneously (either a positive image or a negative image can be obtained from an original using the same developer).

7 Claims, 17 Drawing Figures

ELECTROPHOTOGRAPHIC PROCESS

BACKGROUND OF THE INVENTION

1. Field of the Invention

This invention relates to an electrophotographic process which makes it possible to provide copied images from positive to positive (or negative to negative) and positive to negative (or negative to positive) in relation to the original simply by changing the polarity of charging through the use of a photosensitive element having an electrically insulating surface layer.

2. Description of the Prior Art

Of photosensitive elements hertofore practically used for electrophotography, typical elements are those in which layers of a photoconductive substance such as Se, Se alloy, Zn oxide and cadmium sulfide are provided on an electrically conductive substrate. However, all of these photosensitve elements have been usable only where the charging has either a positive or negative polarity. The foregoing photosensitive elements cannot be used for charging of polarities because the charging is poorer for one polarity, the sensitivity thereof is deteriorated due to a poorer movement of electric charge carriers for one polarity, or because a space charge trapped in the bulk is accumulated in the photosensitive element and thus, the residual potential increases. In the case of an Se system photosensitive material, for instance, the following problems have occurred. When the material is negatively charged, positive charge carriers are injected from the electrically conductive substrate thereby apparently reducing the amount of charging and consequently, the sensitivity as a photosensitive element is deteriorated, or since the trapping of negative charges internally present plays a major role, when negative charging and exposure to light are repeated, the resultant accumulation of negative space charge in the photosensitive element increases the residual potential, thus leading to deteriorated reuse properties.

On the other hand, regarding the process of electrophotography and photosensitive elements, U.S. Pat. No. 3,041,167 discloses a process in which an electrostatic latent image is formed through a series of steps comprising a first charging; a light exposure of the entire surface; a second charging in a polarity opposite that of the first charging; and an image-wise exposure to light.

As will be seen in FIG. 2 of the accompanying drawings, the photosensitive element used in this process basically comprises three layers, an electrically insulating surface layer 3, a photoconductive layer 2, and an electrically conductive substrate 1, the electrically insulating surface layer 3 being transparent to radiation to which the photosensitive layer 2 is sensitive.

The process as described above will be briefly explained with reference to FIG. 2. A transparent electrically insulating surface layer 3 in the photosensitive element having the structure as described above is initially charged at a certain polarity (FIG. 2*a*), and then, entirely exposed to light to form an electric charge opposite to that on the surface at the boundary between the electrically insulating layer 3 and the photoconductive layer 2 (FIG. 2*b*). Subsequently, a charging in a polarity opposite to the polarity of the first charging is effected to neutralize the charge on the surface, on the one hand, and to induce on the electrically conductive substrate 1 a charge of a polarity opposite to that existing at the boundary as mentioned above, on the other hand. Finally, the element is image-wise exposed to light to discharge the charge existing at the boundary corresponding to the image-wise exposure and ultimately to form an electrostatic latent image at the boundary between the electrically insulating layer 3 and the photoconductive layer 2 (FIG. 2*d*).

Since treatments such as development, transfer, and cleaning are effected only on the electrically insulating layer, this photosensitive element has various advantages such as extended life and no precautions are required due to possible toxicity problems because the photoconductive layer is covered with the electrically insulating surface layer. One of the features in the process of using this photosensitive element is that the accumulation of space charge is limited because both positive and negative carriers flow through the photosensitive element. However, in the photosensitive element as described above, because charge carriers are injected from the electrically conductive substrate, a good picture image can not be obtained where the sensitivity thereof is deteriorated or the polarity of the charging must be reversed in use because of a decreased S/N ratio (signal/noise ratio).

SUMMARY OF THE INVENTION

Accordingly, a primary object of the present invention is to provide an electrophotographic process by which either a positive image of an original or a negative image of an original can be selectively obtained by use of a photosensitive element for electrophotography completely eliminating the defect as seen in the past.

The present invention is an improvement in the conventional photosensitive element to ensure use of both polarities. This makes it possible to selectively obtain copies from positive to positive (or negative to negative) and negative to positive (or positive to negative). It should be noted that the photosensitive element concurrently has the advantages as described above, derived from the electrically insulating layer provided on the surface.

Accordingly, this invention provides an electrophotographic process for the formation of an electrostatic latent image which comprises initially electrically charging a photosensitive element comprising an electrically conductive substrate having laminated thereon in order an electrically insulating intermediate layer, a photoconductive layer, and an electrically insulating surface layer; exposing the entire surface of the photosensitive element to light; subsequently electrically charging the photosensitive element in a polarity opposite to that of the initial charging; and then image-wise exposing the photosensitive element to light.

DETAILED DESCRIPTION OF THE INVENTION

Figure 1:
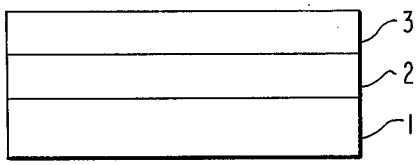
FIGS. 1 and 2 are drawings illustrating the steps of the conventional process and FIGS. 3 to 6, inclusive, are drawings illustrating the process of the present invention.
Figure 2A:
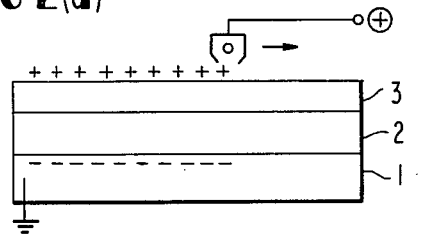
Figure 2B:
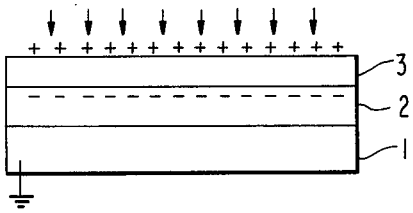
Figure 3:
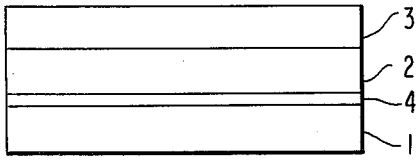
Figure 2C:
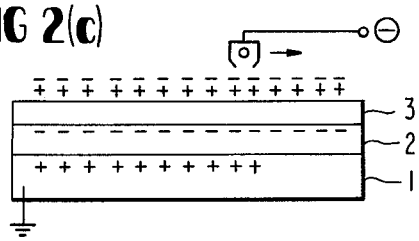
Figure 2D:
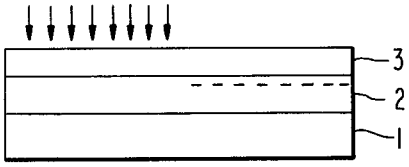

As seen in FIG. 3, the photosensitive element used in the process according to the invention comprises an electrically insulating intermediate layer 4, a photoconductive layer 2, and an electrically insulating surface layer 3 laminated on an electrically conductive substrate in this order. Regarding the photoconductive layer 3, various photoconductive substances, organic or inorganic, can be used. For instance, amorphous Se is a preferred material. To improve crystallization-resistance, Se and As alloys containing 0.1 to 5 percent by weight of As are also preferred. For the purpose of sensitization, Se alloys containing 1 to 50 percent by weight of Te or As or a material combining two compositions whose content of Te or As each differs can be used. These materials may contain small amounts (e.g., less than about 1,000 ppm) of halogens such as F and Cl and small amounts (e.g., less than about 1,000 ppm) of elements included in Group III b of the Periodic Table, such as Tl and In, in order to adjust the electric properties. Photoconductive substances such as CdS and ZnO may also be used. Organic photoconductive substances may be used by sensitizing poly-N-vinylcarbazole (PVK) with a chemical sensitizing material such as a poly-N-vinylcarbazole/2,4,7-trinitro-9-fluorene (PVK/TNF) system, by sensitizing with a dye or by dispersing a dye in the binder. The thickness of the photoconductive layer ranges from about 1 to about 200μ, preferably from 5 to 80μ.

With regard to the electrically insulating surface layer 3 used according to the present invention, it is desirable for the electrical resistance thereof to be set at a high level sufficient to retain an electric charge and for the layer to have a high wear resistance. The layer should also be transparent to radiation to which the photoconductive layer 2 is sensitive. To be more specific, high molecular weight films, for instance, those made of urethane resins, polyethylene resins, polyester resins, fluorocarbon resins, polycarbonate resins, cellulose acetate resins, and polyvinyl chloride resins and inorganic electrically insulating materials, for instance, glass and ceramics made of $SiO_2$, $Al_2O_3$ and the like can be used. The thickness of the electrically insulating surface layer 3 ranges from about 1 to about 50μ, preferably 5 to 30μ.

With regard to the electrically insulating intermediate layer 4 positioned between the electrically conductive substrate 1 and the photoconductive layer 2, the electrical resistance thereof must be set at a high level sufficient to prevent charge carriers from injecting in. Good adhesiveness between the electrically conductive substrate 1 and the photoconductive layer 2 is also required. However, the intermediate layer 4 does not need to be transparent. To be more specific, high molecular weight films and inorganic electrically insulating materials suitable as materials for the electrically insulating surface layer 3 as described above can be all used for this electrically insulating intermediate layer. The thickness of the electrically insulating intermediate layer ranges from about 0.1 to about 20μ, preferably 1 to 10μ.

With regard to the electrically conductive support, the only requirement for such is electrical conductivity. For instance, metal electrically conductive materials such as aluminum, copper, nickel, and tin, those materials produced by rendering resin films electrically conductive, hygroscopic papers and those materials produced by attaching an aluminum foil on a paper are suitable.

The use of the photosensitive element as mentioned above makes it possible to obtain a copy of good consistent quality by forming an electrostatic latent image using the process described in U.S. Pat. No. 3,041,167, namely, that comprising a first charging, a light exposure of the entire surface, a second charging in a polarity opposite to that of the first charging, and an image-wise exposure to light. In addition, if the polarity of both the first and second charging is reversed simultaneously, a reversal of the nature of the image obtained can be achieved without changing the developer.

A brief explanation will be made below on the process of the present invention with the description being in reference to obtaining a reversal image by use of a photosensitive element provided with an electrically insulating intermediate layer by reference to FIG. 4 and FIG. 5.

Figure 4A:
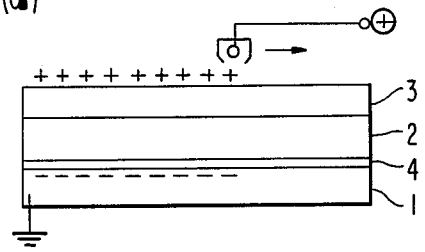
Figure 4B:
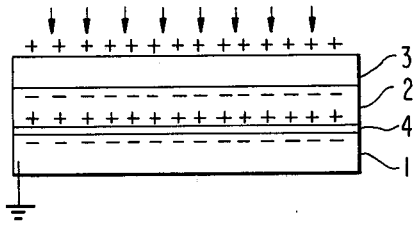
Figure 4C:
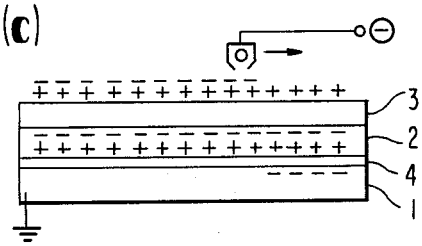
Figure 5C:
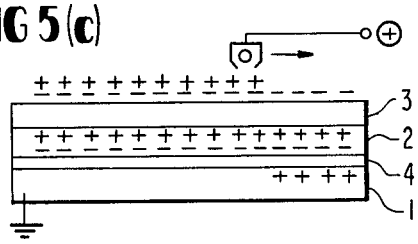
Figure 4D:
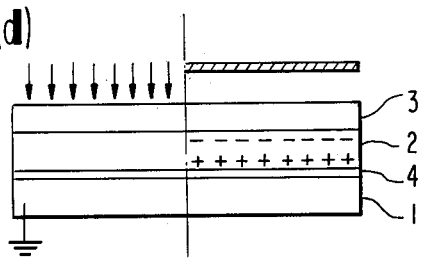
Figure 5D:
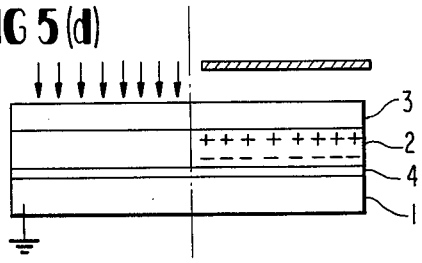
Figure 4E:
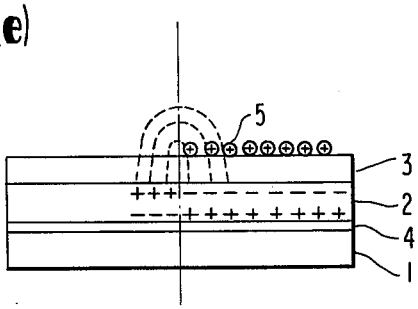
Figure 5E:
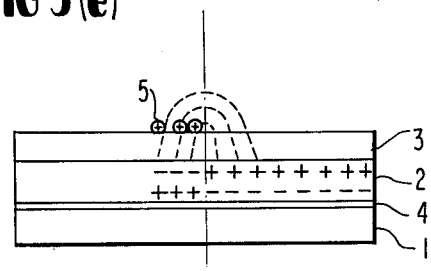

The electrically insulating surface layer 3 of the photosensitive element having a structure as shown in FIG. 3 is initially charged in a certain polarity (positive in FIG. 4 and negative in FIG. 5) (FIG. 4*a* and FIG. 5*a*), and then entirely exposed to light to polarize the photoconductive layer 2 in a manner such that an electric charge of a polarity opposite to that on the surface is formed at the boundary between the electrically insulating surface layer 3 and the photoconductive layer 2 (FIG. 4*b* and FIG. 5*b*), and a second charging in a polarity opposite to that of the first charging is effected to neutralize the charge on the surface (FIG. 4*c* and FIG. 5*c*). Subsequently, an image-wise exposure to light is conducted to neutralize charges in the areas exposed to light by discharging so that an electrostatic latent image is be formed at the boundary between the electrically insulating surface layer 3 and the photoconductive layer 2 (FIG. 4*d* and FIG. 5*d*).

Where the electrostatic latent image formed by the neutralization is developed using a toner having certain charge polarity, for instance, a positively charged toner 5 as shown in FIGS. 4 and 5, a negative charge is induced corresponding to the image in the image of a negative polarity, as shown in FIG. 4(*e*), while it is done on the surface of the photoconductive layer 2 surrounding the image due to edge effect in the image of a positive polarity as shown in FIG. 5(*e*). Consequently, the toner 5 is attracted to form a negative image. It should be noted that in the case of the latter, since only the portion subjected to the edge effect is developed, it is applicable to a line image but not to the reproduction of an image of a continuous gradation.

Figure 6:
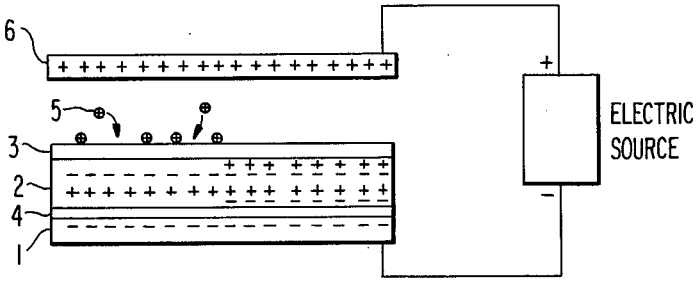
Figure 5A:
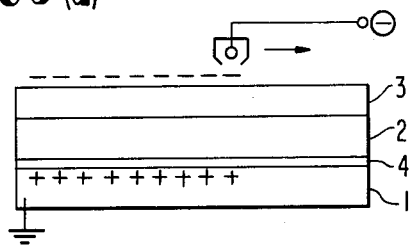
Figure 5B:
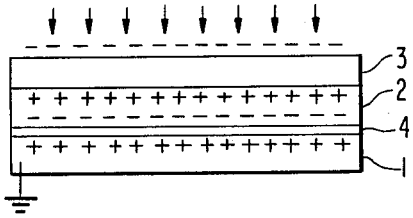

To reproduce an image of a continuous gradation, as seen in FIG. 6, a developing electrode is provided in a manner that a voltage equal to that of the electrostatic latent image is produced thereat by controlling the voltage thereof. In the case of FIG. 5*d*, under these conditions, a negative charge is induced on the surface of the photosensitive plate. Consequently, a positive charge in the portion initially showing the largest charge density is neutralized while in the portion initially showing a positive charge density of zero, a negative charge density equal to the positive charge density previously showing the largest charge density is produced. In the intermediate portion, an excessive negative charge inversely proportional to the positive charge as previously shown in produced. Therefore, a reversal image having good reproducibility of continuous gradation is obtainable if development is conducted using a positively charged toner 5 with a powder cloud method and the like.

The present invention will be further explained in greater detail with reference to a specific example thereof. Unless otherwise indicated herein, all parts, percents, ratios and the like are by weight.

EXAMPLE

A urethane resin was coated on an aluminum support at a thickness of about 5μ and a 60μ thick film of Se was formed thereon using a process of vacuum vapor-deposition. Here, the temperature of the support was kept between 60° C. and 70° C. Then, a 12μ thick polyester film was adhered on the Se film thus formed with an epoxy resin to produce a photosensitive element.

Subsequently, the photosensitive element thus produced was charged on the surface of the electrically insulating layer with a corona discharge of −5.5 KV, then, entirely exposed to light in a light quantity of about 10 lux/sec., and charged with a corona discharge of +5.5 KV. Finally, the element was image-wise exposed to light in a light quantity of about 10 lux/sec. As a result, an electrostatic latent image having an electrostatic contrast of about 800 V was obtained. The electrostatic latent image was developed using cascade development with a developer comprising a negatively charged toner and a positively charged carrier. By so doing, a high quality positive image of the original was obtained.

Subsequently, following the first charging effected with a corona discharge of +6 KV, a series of steps comprising light exposure of the entire surface in a light quantity of 10 lux/sec. was continuously conducted. By so doing, a reverse image to the original could be obtained with the same developer. Thus, it was found that a change from positive to positive (or negative to negative) and negative to positive (or positive to negative) could be easily effected simply by changing the charging polarity.

As clearly shown by the example as described above, it is possible according to the present invention for images to be selectively obtained as desired from positive to positive (or negative to negative) and from negative to positive (or positive to negative) through a very simple manipulation and use of the same developer.

While the invention has been described in detail and with reference to specific embodiments thereof, it will be apparent to one skilled in the art that various changes and modifications can be made therein without departing from the spirit and scope thereof.

What is claimed is:

1. An electrophotographic process for the formation of an electrostatic latent image which comprises the steps of:

(a) initially electrically charging a photosensitive element comprising an electrically conductive substrate having laminated thereon, in order, an electrically insulating intermediate layer, a photoconductive layer and an electrically insulating surface layer, whereby the surface of said electrically insulating surface layer is electrically charged in a certain polarity;

(b) entirely exposing said photosensitive element to light from the side of the surface of the electrically insulating surface layer to polarize said photoconductive layer such that an electric charge of a polarity opposite to that on the surface is formed at the boundary between said electrically insulating surface layer and said photoconductive layer;

(c) subsequently electrically charging said electrically insulating surface layer in a polarity opposite to that of said initial charging to neutralize the electric charge on the surface; and then (d) image-wise exposing said photosensitive element to light from the side of the surface of the electrically insulating surface layer to neutralize charges in the areas exposed to light by discharging so that said electrostatic latent image is formed at the boundary between said electrically insulating surface layer and said photoconductive layer, wherein the polarity between the initial electrical charging and the subsequent electrical charging is changed from positive to negative, or vice-versa, simultaneously at the time when said image-wise exposing to light occurs.

2. The electrophotographic process of claim 1, wherein said initial charging is of a positive polarity and said subsequent charging is of a negative polarity.

3. The electrophotographic process of claim 1, wherein said initial charging is of a negative polarity and said subsequent charging is of a positive polarity.

4. The electrophotographic process of claim 1, wherein said photoconductive layer comprises a layer of an inorganic or organic photoconductive material.

5. The electrophotographic process of claim 1, wherein said electrically insulating intermediate layer and said electrically insulating surface layer each comprises a layer of an electrically insulating organic high molecular weight material or an electrically insulating inorganic material.

6. The electrophotographic process of claim 5, wherein said high molecular weight material is a urethane resin, a polyester resin, a fluorocarbon resin, a polycarbonate resin, a polyethylene resin, a cellulose acetate resin or a polyvinyl chloride resin, and said electrically insulating inorganic material is $SiO_2$ or $Al_2O_3$.

7. The electrophotographic process of claim 1, wherein said electrically conductive substrate comprises a substrate of an electrically conductive metal, a synthetic resin film rendered electrically conductive, a paper laminated with an aluminum foil or a paper rendered hygroscopic.

* * * * *